United States Patent [19]

Murakami et al.

[11] Patent Number: 4,680,235

[45] Date of Patent: Jul. 14, 1987

[54] RECORDING MATERIAL FOR INK JET PRINTING

[75] Inventors: Kakuji Murakami, Shizuoka; Eiichi Akutsu, Ichikawa; Tamotsu Aruga, Numazu, all of Japan

[73] Assignee: Ricoh Company, Ltd., Tokyo, Japan

[21] Appl. No.: 714,873

[22] Filed: Mar. 22, 1985

[30] Foreign Application Priority Data

Mar. 23, 1984 [JP] Japan ..... 59-54314

[51] Int. Cl.[4] ..... B41M 5/00

[52] U.S. Cl. ..... 428/414.4; 428/500; 428/520; 428/524; 428/527; 428/532; 428/704; 428/195; 428/257; 428/411.1; 428/418.2

[58] Field of Search ..... 428/195, 207, 211, 411.1, 428/474.4, 478.2, 500, 520, 524, 527, 532, 704; 346/135.1

[56] References Cited

U.S. PATENT DOCUMENTS 4,371,582 2/1983 Sugiyama et al. ..... 428/211

FOREIGN PATENT DOCUMENTS 0087987 6/1982 Japan ..... 428/195
0089391 5/1983 Japan ..... 428/207

OTHER PUBLICATIONS

Edds et al., IBM Tech. Dis. Bul., vol. 22, #8A, Jan. 1980, "Paper Treatment Enhancement of Ink Drying In Ink Jet Printers".

*Primary Examiner*—Bruce H. Hess
*Attorney, Agent, or Firm*—Oblon, Fisher, Spivak, McClelland & Maier

[57] ABSTRACT

A recording material for ink jet printing for forming images thereon with an ink composition by ink jet printing is disclosed, which comprises a base material and a surface recording layer formed thereon, the surface recording layer contains at least a surface active agent which does not form a material insoluble in the ink composition in combination with a dye contained in the ink composition.

13 Claims, 4 Drawing Figures

RECORDING MATERIAL FOR INK JET PRINTING

BACKGROUND OF THE INVENTION

The present invention relates to a recording material for ink jet printing and more particularly to a recording material which comprises a base material and a surface recording layer formed thereon and which is capable of allowing ink jet recording with the same dot size as on the conventionally employed non-sized paper and accordingly allowing perfect recording of solid images thereon even if printing is performed by an ink jet printing apparatus designed for use with such non-sized paper. The base material for this recording material is not limited to ink-absorbing materials, but it can be made of a material which does not absorb any liquid ink, such as a plastic film or plate, glass or ceramics.

Conventionally, the following recording sheets for ink jet printing are proposed: an ink jet recording sheet of a coated sheet type which comprises a sheet of plain paper and a recording layer formed thereon, which recording layer contains a polymeric binder agent or a pigment for increasing the density or resolution of the recorded images on the recording sheet (Japanese laid-open patent applications 57-93193 and 57-70691), and a non-porous recording material for ink jet printing, particularly for use with an overhead projector, which includes a surface layer containing a particular material which dissolves or swells in a liquid ink (Japanese laid-open patent application 56-80489).

Furthermore, for the purpose of increasing the water-resistance of the images recorded by ink jet printing on a recording medium, there is proposed in Japanese laid-open patent application 56-99636 an ink jet recording method of printing images on a recording medium containing a cationic surface active agent on the surface layer thereof by an aqueous ink containing at least a water-soluble direct dye or a water-soluble acidic dye.

Generally as the recording sheets for ink jet recording, non-sized sheets having high water absorbing capacity are employed. Accordingly the ink jet printing apparatus in general use is designed so as to yield an appropriate dot size when such non-sized sheets are employed. Therefore, when jet printing is performed on the above mentioned coated sheets and on the sheet for overhead projectors, an appropriate dot size cannot be obtained because of insufficient ink absorption of the ink and insufficient spreading of the printed dots on the sheets. The result is that perfect solid images cannot be formed, but non-printed areas are formed in the images to be solid. In particular, it is almost impossible to form perfect solid images on transparent sheets which are in general use for overhead projectors.

SUMMARY OF THE INVENTION

It is therefore an object of the present invention to provide a recording material for ink jet printing which is capable of allowing ink jet recording with the same dot size as on the conventionally employed non-sized paper and accordingly allowing perfect recording of solid images thereon even if the base material of the recording material is non-porous and non-water-penetrating and has a low surface energy, for instance, a plastic recording film for use with overhead projectors is employed, and ink jet printing is performed by an ink jet printing apparatus designed for such non-sized paper.

The above object of the present invention can be attained by a recording sheet which comprises a base material and a surface recording layer formed on the base material, which surface recording layer contains at least a surface active agent which, when coming into contact with an ink composition at the time of ink jet printing, does not form a material insoluble in the solvent of the ink composition on the surface recording layer.

DETAILED DESCRIPTION OF THE PREFERRED EMBODIMENTS

By referring to the accompanying drawings, embodiments of a recording material for ink jet printing according to the present invention will now be explained more specifically.

Figure 1:
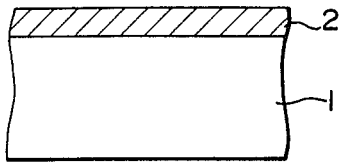
FIG. 1 is a schematic cross-sectional view of an embodiment of a recording material for ink jet printing according to the present invention.

FIG. 1 shows an embodiment of a recording material for ink jet printing according to the present invention. In the figure, reference numeral 1 indicates a base material and a reference numeral 2 indicates a surface recording layer for recording images thereon.

The surface recording layer 2 comprises at least a surface active agent, if necessary with addition thereto of a binder agent, a white pigment and other additives. The surface recording layer 2 is capable of absorbing the solvent of the ink droplets impinged thereon.

Figure 2:
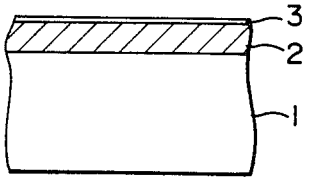
FIG. 2 is a schematic cross-sectional view of another embodiment of a recording material for ink jet printing according to the present invention.

FIG. 2 shows another embodiment of a recording material according to the present invention. This embodiment further comprises a surface active agent layer 3 consisting essentially of a surface active agent, which is formed on the surface recording layer 2.

Figure 3:
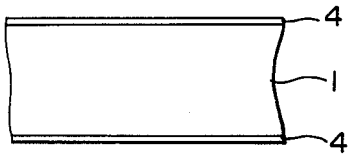
FIG. 3 is a schematic cross-sectional view of a further embodiment of a recording material for ink jet printing according to the present invention.

FIG. 3 shows a further embodiment of a recording material according to the present invention, which comprises a base material 1 and a pair of sizing layers 4 with which both sides of the base layer 1 are coated and the penetration of the ink is appropriately controlled by the sizing layers 4. The sizing layer 4 is a conventional sizing layer for controlling the penetration of the ink, which comprises rosin, aluminum sulfate and wax. In this embodiment the sizing layers 4 and the base layer 1 are entirely impregnated with a surface active agent. Thus, there is no particular distinction between the surface recording layer and the base material in this embodiment.

Figure 4:
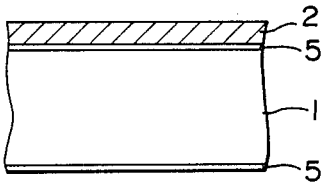
FIG. 4 is a schematic cross-sectional view of still another embodiment of a recording material for ink jet printing according to the present invention.

FIG. 4 shows still another embodiment of a recording material according to the present invention. In this embodiment, both sides of the base sheet 1 are coated with a precoat layer 5, and the surface recording layer 2 is formed on one of the precoat layers 5. The precoat layer 5 is also a conventional precoat layer formed by coating a vinyl acetate emulsion in which clay or zinc oxide is dispersed.

The above embodiments are exemplary and as a matter of course, the present invention is not limited to these examples.

In the present invention, when an ink composition contains an anion-type dye such as a water-soluble acidic dye or a direct dye, it is preferable to use anionic surface active agents or nonionic surface active agents in the surface recording layer.

Specific examples of the anionic surface active agents for use in the present invention are alkylsulfates such as sodium lauryl sulfate, monoethanolamine lauryl sulfate, triethanolamine lauryl sulfate and sodium cetyl sulfate; polyoxyethylene alkyl ether sulfates such as polyoxyethylene lauryl ether sodium sulphate, polyoxyethylene lauryl ether triethanolamine sulphate and polyoxyethylene nonylphenyl ether sodium sulphate; alkyl phosphates such as sodium lauryl phosphate and sodium oleyl phosphate; polyoxyethylene alkyl ether phosphate such as polyoxyethylene lauryl ether sodium phosphate, tripolyoxyethylene alkyl ether phosphate and dipolyoxyethylene alkyl ether phosphate; alkylbenzene sulfonic acid such as dodecylbenzene sulfonic acid; polyoxyethylene alkyl ether acetate, alkylsulfo succinate, α-olefin sulfonate, acyl collagen peptide salts, N-acylmethyltaurine salts, N-acylamines, N-acylamine chlorides and fluorine-containing surface active agents.

Specific examples of the nonionic surface active agents for use in the present invention are polyoxyethylene alkyl ethers such as polyoxyethylene lauryl ether, polyoxyethylene cetyl ether, polyoxyethylene oleyl eter; polyoxyethylene alkylphenyl ethers such as polyoxyethylene nonylphenyl ether and polyoxyethylene octylphenyl ether; soribitan fatty acid esters such as sorbitan monooleate, sorbitan monopalmitate and sorbitan tristearate; glycerol fatty acid esters such as glycertyl monostearate and glyceryl dioleate; polyoxyethylene alkylamines such as polyoxystearylamine and polyoxyethyleneoleylamine; polyoxyethylene fatty acid amides, polyoxyethylene lanolin derivatives, polyoxyethylene fatty acid esters, polyglycerol fatty acid esters, propylene glycol fatty acid esters, pentaerythritol fatty acid esters, polyoxyethylene sorbitan fatty acid esters, polyoxyelethylene sorbit fatty acid ester, and fluorine-containing nonionic surface active agents.

When the ink composition contains a cationic dye, that is, a basic dye, it is preferable to use cationic surface active agents and nonionic surface active agents.

Specific examples of the cationic surface active agents are quaternary ammonium salts such as benzalkonium chloride and cetyltrimethylammonium bromide.

When an oil dye or a disperse dye is employed in the ink composition, cationic surface active agents, anionic type surface active agents, nonionic surface active agents and amphoteric surface active agents can be employed.

As the base sheet for the present invention, paper, transparent and opaque plastic sheets, glass, ceramics and metal plates can be employed.

When the recording material can be opaque, a white pigment and a binder agent can be also contained in the surface recording layer 2. When the surface recording layer 2 is composed of a surface active agent, a binder agent and a white pigment, it is preferable that the surface active agent be in an amount ranging from 0.5 wt.% to 5 wt.%, the binder agent be in an amount ranging from 5 wt.% to 30 wt.% and the white pigment be in an amount ranging from 65 wt.% to 95 wt.%.

Examples of such white pigment are barium sulfate, calcium carbonate, silica, zinc oxide, titanium oxide, clay, talc, diatomaceous earth, zinc sulfide, zinc carbonate and zeolite.

Examples of the binder agent are polyvinyl alcohol, ethylcellulose, hydroxyethylcellulose, carboxymethylcelluose, starch, polyvinyl butyral, polyacrylamide, sodium polyacrylate, maleic anhydride resin, gelatin, arabic gum, casein, polyvinyl pyrrolidone, sodium alginate, latex polymer, polyamide, cellulose sulfate, carboxy-modified polyvinyl alcohol, polyethyleneimine, soybean protein, polyvinyl sulfonic acid, sodium salt of ethylene - maleic anhydride copolymer, ethylene - maleic anhydride copolymer, and cationic polymers containing quaternary ammonium salts.

When the recording material must be transparent, the above-mentioned white pigments are not employed in the surface recording layer, but it is composed of one of the previously mentioned surface active agents and one of the above binder agents, and is formed on a transparent base material.

The above-mentioned binder agents are soluble or swell in aqueous inks.

When the content of water in the aqueous inks is small or oil inks are employed, water-insoluble polymeric materials such as polymethyl acrylate, polymethyl methacrylate, polyvinyl chloride, polystyrene and polyvinyl acetate can be employed in the surface recording layer 2.

In order to improve the fixing performance and stability of the printed images, when the acidic dyes or direct dyes are employed, the following agents serving as image stabilizing agents can be added to the surface recording layer 2, preferably in an amount ranging from 0.1 $g/m^2$ to 10 $g/m^2$ in such a manner that the concentration thereof increases towards the base material: the aforementioned cationic surface active agents, inorganic compounds capable of forming insoluble salts in combination with the dyes in the ink compositions, for example, $FeCl_3$, $SnCl_4$, $AlCl_3$, $FeSO_4$, $NiCl_2$, $CaCl_2$, $MgCl_2$, $CaSO_4$, $CO(NO_3)_2$, $COCl_2$, $ZnCl_2$, $SrCl_2$, $PbCl_4$, $CuSO_4$, $BaCl_2$, $Ba(NO_3)_2$, $Ba(OH)_2$, $InCl_3$ and $Ga(SO_4)_2$; alkylamine salts such as decylamine acetate, undecylamine acetate, dodecylamine hydrochloride, hexadecylamine sulfate, eicodecylamine acetate; polyamide polyamine, polydimethylaminoethyl methacrylate, polymers containing polyalkylamonnium salt, polymers containing basic groups such as basic latex. The above agents also work as water-proof agent for the acidic dyes and direct dyes.

Further, in the surface recording layer 2, an anti-oxidation agent, an ultraviolet absorbing agent, a fluorescent dye for increasing whiteness and a plasticizer can be contained.

Specific examples of the anti-oxidation agent are pyrogallol, hydroquinone, p-t-butylphenol, diphenylamine, hydroquione dimethyl ether, benzotriazole, styrenated phenol, methylhydroquinone and monoisopropyl citrate.

As the ultraviolet absorbing agent, benzotriazole compounds such as 2-(2'-hydroxy-5'-t-butylphenyl)-5-chlorobenzotriazole are preferable for use.

By referring to the following examples, the present invention will now be explained in more detail.

EXAMPLE 1-1

A 5 wt.% aqueous solution of polyoxyethylene cetyl ether (commercially available under the name of BC-15TX from Nikko Chemicals Co., Ltd.) was prepared for use as a surface active agent solution in the present invention.

The thus prepared surface active solution was sprayed on the surface of a commercially available ink jet recording sheet (M-coat paper made by Mitsubishi Paper Mills, Ltd.), whereby a recording material No. 1-1 according to the present invention was prepared.

A magenta ink was prepared in accordance with the following formulation:

| | Parts by Weight |
|---|---|
| Acid Red 52 | 2 |
| Polyethylene glycol (M.W. 200) | 7 |
| N—methyl-2-pyrrolidone | 6 |
| Sodium dehydroacetate | 0.5 |
| Ion-exchanged water | 84.5 |

Ink jet printing was performed on the recording material No. 1-1 by a commercially available ink jet printer using the above prepared magenta ink.

The result was that the size of the recorded dot was 320 μm and perfect solid images free from non-printed areas were obtained.

EXAMPLE 1-2

A polyethylene terephthalate film coated with polyvinyl pyrrolidone with a thickness of 10 μm was coated with the 5 wt.% of aqueous solution of polyoxyethylene cetyl ether prepared in Example 1-1 by spraying the solution thereto, so that a recording material No. 1-2 according to the present invention was prepared.

On this recording material, ink jet printing was performed in the same manner as in Example 1-1. The result was that the size of the recorded dot was 310 μm and solid images free from non-printed areas were obtained.

EXAMPLE 1-3

A sheet of commercially available high quality paper (Ricoh PPC Paper Type 1000 made by Ricoh Company, Ltd.) was coated with a 1 wt.% aqueous solution of polyoxyethylene cetyl ether (which was prepared by diluting the aqueous solution of polyoxyethylene cetyl ether employed in Example 1-1) by spraying the solution thereto, so that a recording material No. 1-3 according to the present invention was prepared.

On this recording material, ink jet printing was performed in the same manner as in Example 1-1. The result was that the size of the recorded dot was 320 m and solid images free from non-printed areas were obtained.

COMPARATIVE EXAMPLE 1-1

Example 1-1 was repeated except that the M-coat paper was not coated with the solution of polyoxyethylene cetyl ether employed in Example 1-1.

The result was that the size of the recorded dot was 200 μm and the images to be solid contained non-printed areas.

COMPARATIVE EXAMPLE 1-2

Example 1-2 was repeated except that the polyethylene terephthalate film coated with polyvinyl pyrrolidone was not coated with the solution of polyoxyethylene cetyl ether employed in Example 1-2.

The result was that the size of the recorded dot was 190 μm and the images to be solid contained non-printed areas.

COMPARATIVE EXAMPLE 1-3

Example 1-3 was repeated except that the PPC paper was not coated with the solution of polyoxyethylene cetyl ether.

The result was that the size of the recorded dot was 180 μm and the images to be solid contained non-printed areas.

COMPARATIVE EXAMPLE 1-4

Ink jet printing was performed on an ordinary non-sized sheet in the same manner as in Example 1-1, using the same magenta ink as that employed in Example 1-1.

The result was that the size of the recorded dot was 310 μm and perfect solid images were obtained.

In the following table, the above results are summarized:

| | Example 1-1 | Example 1-2 | Example 1-3 | |
|---|---|---|---|---|
| Base Material | M-coat paper | PVP-coated PET film | PPC paper | — |
| Surface Active Agent Treatment | POC | POC | POC | — |
| Printed Dot Size | 320 μm | 310 μm | 320 μm | — |
| Solid Image Area | Perfect | Perfect | Perfect | — |
| | Comparative Example 1-1 | Comparative Example 1-2 | Comparative Example 1-3 | Comparative Example 1-4 |
| Base Material | M-coat paper | PVP-coated PET film | PPC paper | Non-sized paper |
| Surface Active Agent Treatment | None | None | None | None |
| Printed Dot Size | 200 μm | 190 μm | 180 μm | 310 μm |
| Solid Image Area | Imperfect | Imperfect | Imperfect | Perfect |

Note:
PVP: Polyvinyl pyrrolidone
PET: Polyethylene terephthalate
POC: Polyoxyethylene cetyl ether

EXAMPLE 2

A mixture of the following components was heated with stirring, whereby a surface recording layer formation liquid was prepared:

| | Parts by Weight |
|---|---|
| Polyvinyl alcohol (commercially available under the name of Poval PVA-420 from Kuraray Co., Ltd.) | 5 |
| Polyvinyl pyrrolidone (K-30 commercially available under the name of K-30 from Tokyo Kasei | 10 |

-continued

| | Parts by Weight |
|---|---|
| Co., Ltd.) | |
| Polyoxyethylene octylphenyl ether (commercially available under the name of OP-10 from Nikko Chemicals, Co., Ltd.) | 1 |
| Water | 40 |
| Methanol | 40 |

The thus prepared surface recording layer formation liquid was coated on a plyethylene terephthalate film by a doctor blade, and was then dried at 100° C., whereby a surface recording layer with a thickness of 15 μwas formed on the polyethylene terephthalate film, whereby a recording material No. 2 according to the present invention was prepared.

On this recording material ink, jet printing was performed in the same manner as in Example 1-1. The result was that the size of the printed dot was 310 μm and perfect solid images were obtained.

COMPARATIVE EXAMPLE 2

Example 2 was repeated except that polyoxyethylene octylphenyl ether was eliminated from the formulation of the surface recording layer formation liquid in Example 2, whereby a comparative recording material No. 2 was prepared.

On this comparative recording material, ink jet printing was performed in the same manner as in Example 1-1. The result was that the size of the printed dot was 200 μm and no perfect solid images were obtained.

What is claimed is:

1. An ink jet recording material for forming images thereon with an ink composition by ink jet printing comprising a non-porous base material and a surface recording layer formed thereon, said surface recording layer containing a surface active agent selected from the group consisting of anionic and cationic surface active agents which does not form a material insoluble in said ink composition when contacted with a dye contained in said ink composition, and a binder agent which is soluble or swells in an aqueous ink.

2. A recording material for ink jet printing as claimed in claim 1, wherein said surface active agent contained in said surface recording layer is an anionic surface active agent when said ink composition contains an anionic dye.

3. A recording material for ink jet printing as claimed in claim 2, wherein said anionic surface active agent is selected from the group consisting of alkylsulfates, polyoxyethylene alkyl ether sulfates, alkyl phosphates, polyoxyethylene alkyl ether phosphate, alkylbenzene sulfonic acid, polyoxyethylene alkyl ether acetate, alkylsulfo succinate, α-olefin sulfonate, acyl collagen peptide salts, N-acylmethyltaurine salts, N-acylamines, N-acylamine chlorides and fluorine-containing surface active agents.

4. A recording material for ink jet printing as claimed in claim 2, wherein surface recording layer further contains an image stabilizing agent in an amount ranging from 0.1 g/m$^2$ selected from the group consisting of benzalkonium chloride, cetylmethylammononium bromide, $FeCl_3$, $SnCl_4$, $AlCl_3$, $FeSO_4$, $NiCl_2$, $CaCl_2$, $MgCl_2$, $CaSO_4$, $CO(NO_3)_2$, $COCl_2$, $ZnCl_2$, $SrCl_2$, $PbCl_4$, $CuSO_4$, $BaCl_2$, $Ba(NO_3)_2$, $Ba(OH)_2$, $InCl_3$ and $Ga(SO_4)_2$, decylamine acetate, undecylamine acetate, dodecylamine hydrochloride, hexadecylamine sulfate, eicodecylamine acetate; polyamide polyamine, polydimethylaminoethyl methacrylate, polymers containing polyalkylamonnium salt, and polymers containing basic groups.

5. A recording material for ink jet printing as claimed in claim 4, wherein the concentration of said image stabilizing agent in said surface recording layer increases towards said base material.

6. A recording material for ink jet printing as claimed in claim 1, wherein said surface active agent contained in said surface recording layer is a cationic surface active agent when said ink composition contains a cationic dye.

7. A recording material for ink jet printing as claimed in claim 6, wherein said cationic surface active agent is selected from the group consisting of benzalkonium chloride and cetylmethylammonium bromide.

8. A recording material for ink jet printing as claimed in claim 1, wherein said surface active agent contained in said surface recording layer is a cationic surface active agent when said ink composition contains an oil dye or a disperse dye.

9. A recording material for ink jet printing as claimed in claim 1, wherein said surface recording layer contains a white pigment in addition to said surface active agent and said binder agent, said surface active agent in an amount ranging from 0.5 wt.% to 5 wt%, said binder agent in an amount ranging from 5wt.% to 30 wt% and said white pigment in an amount ranging from 65 wt.% to 95 wt.%.

10. The recording material of claim 1, wherein said binder agent is selected from the group consisting of polyvinyl alcohol, ethylcellulose, hydroxyethylcellulose, carboxymethylcellulose, starch, polyvinyl butyral, polyacrylamide, sodium polyacrylate, maleic anhydride resin, gelatin, arabic gum, casein, polyvinyl pyrrolidone, sodium alginate, latex polymer, cellulose sulfate, carboxy-modified polyvinyl alcohol, polyethyleneimine, soybean protein, polyvinyl sulfonic acid, sodium salt of ethylene-maleic anhydride copolymer, ethylene-maleic anhydride copolymer, and cationic polymers containing quaternary ammonium salts.

11. The recording material of claim 1, wherein said non-porous base material is transparent.

12. The recording material of claim 1, wherein said non-porous base material is a plastic recording film for use with overhead projectors.

13. The recording material of claim 1, wherein said binder agent is polyamide.

* * * * *